United States Patent [19]

Suess

[11] Patent Number: 4,570,382

[45] Date of Patent: Feb. 18, 1986

[54] FRICTION BALANCE AND JAMB LINER FOR WINDOW SASH

[75] Inventor: Jack E. Suess, Wayland, Mich.

[73] Assignee: Newell Mfg. Co., a Division of Citation-Walthers Co., Lowell, Mich.

[21] Appl. No.: 565,465

[22] Filed: Dec. 27, 1983

[51] Int. Cl.[4] ..... E05D 13/10

[52] U.S. Cl. ..... 49/430; 49/431; 49/435; 49/445

[58] Field of Search ..... 49/445, 434, 436, 181, 49/421, 451, 430, 431, 429

[56] References Cited

U.S. PATENT DOCUMENTS 3,058,176 10/1962 Zegers ..... 49/435

3,482,354 12/1962 Trout ..... 49/181

*Primary Examiner*—Kenneth Downey

*Attorney, Agent, or Firm*—Price, Heneveld, Huizenga & Cooper

[57] ABSTRACT

The specification discloses an improved jamb liner and novel friction shoe balance arrangement for a cottage-style window enabling the friction shoe balance, or positioner, concept to be utilized with window sash having a plow of nonrectangular cross section, and in "non take-out" type double hung or vertical slidable windows. The jamb liner includes a body securable to the jamb and a channel in which the friction shoe rides extending into the sash plow. The channel comprises a pair of sidewalls projecting outwardly from the jamb liner body into the plow, each sidewall including end portions shaped to generally conform to the nonrectangular portion of the plow, and disposed along and adjacent the latter. A pair of shoe abutment walls extend inwardly toward one another from the opposite channel sidewalls, and provide generally coplanar surfaces against which the friction shoe bears.

16 Claims, 9 Drawing Figures

FRICTION BALANCE AND JAMB LINER FOR WINDOW SASH

BACKGROUND OF THE INVENTION

The present invention relates to vertically slidable windows, and more particularly to a jamb liner and friction balance useful in such windows and particularly useful for "cottage-style" windows, i.e., those having "non take-out" sash.

The vertically slidable, "double-hung" window has gained widespread popularity in both residential and commercial constructions. Basically, this window includes a jamb along each side and a pair of the same-sized sash mounted in parallel offset vertical alignment for sliding, by-pass movement between the jambs. Some form of balance or positioner, such as friction shoes or the like, are included in such window assemblies for at least one of the sash so that it can be slid within and stationarily positioned along its travel between the jambs.

One common type of double-hung window is known generally as the "cottage-style" window, which is usually of a comparatively simple and inexpensive type wherein a pair of jamb liners are fixedly secured within the window jamb and the sash is slidably supported between the jamb liners but not tiltable or removable for cleaning, as in more typical but more expensive double-hung windows. In cottage-style windows, each sash usually defines a "plow" (i.e., a continuous groove) along each side, opening toward and interfitting with a protruding ridge or flange on each jamb liner, with the plows and ridges cooperating to maintain the sash or track throughout their travel. The jamb liners also seal, at least to some extent, the sash within the jamb. As indicated above, in double-hung windows the jamb liners incorporate some form of balance and/or friction device to support the sash in various opened (raised) positions, but in cottage-style windows, such refinements are usually absent and whatever frictional contact exists between the jamb liner and sash itself must be relied upon to hold the sash in an elevated position. Since this is unlikely to give good results, the user must typically resort to use of some extraneous object to prop the sash up if he desires to have the window open.

It is much more desirable, in any double-hung window, including cottage-style windows, to provide friction shoes as positioners or "balances", which in double-hung windows typically ride within channels defined by the jamb liner, to hold the sash in place once it is raised. In such double-hung windows where friction shoes are provided, the jamb liner is typically fabricated of a relatively flexible polymeric material such as PVC and typically comprises a base portion extending the full height of the jamb and a pair of spaced sidewalls extending generally perpendicularly from the base portion to define a generally rectangular channel. A pair of abutment walls extend inwardly toward one another perpendicularly from the opposite sidewalls, and the friction shoe rides within the channel, frictionally engaging both the base portion and the abutment walls. A portion of the friction shoe extends between the two abutment walls to support the sash within the jamb liner.

Such friction shoes are usually considered to be useful only with sash having rectangular channels, however, whose spaced sidewalls (or rear and front walls) provide opposite supports for the abutment walls of the rectangular jamb channel, which otherwise flex (distort) outward under the pressure exerted by the friction shoe. Nonrectangular channels (or plows) may not adequately support the relatively flexible vinyl abutment walls, and consequently the unsupported abutment walls may flex excessively under the pressure of the friction shoe so that the sash is not properly supported. Therefore, the friction shoe concept has not previously been used with window sash whose side channels, or plows, have other than rectangular cross sections.

SUMMARY OF THE INVENTION

The aforementioned problems are effectively and advantageously solved by the present invention, which in essence provides an improved jamb liner enabling the friction shoe concept to be utilized in those windows having nonrectangular plows defined by a pair of sidewalls and a concave inner wall extending therebetween.

More particularly, the jamb liner of the invention includes a body portion extending the full height of, and securable to, the jamb, and a channel portion, in which the friction shoe rides, extending away from the jamb liner and into the sash plow. The channel portion comprises a pair of spaced sidewalls, each including a terminal portion closely proximate and generally conforming to the concave plow wall. The channel portion further comprises a pair of abutment walls extending inwardly toward one another from the opposite channel sidewalls to provide a surface opposite the base portion against which the friction shoe can bear. The abutment walls are each positioned mediate the terminal portion of the channel sidewall and the base portion of the jamb liner so that the shoe abutment walls are supported by the channel sidewalls, which in turn may be (but are not necessarily) supported by the sash plow. Therefore, the shoe abutment walls of the jamb channel positively support the friction shoe, enabling the friction shoe concept to be utilized in windows whose sash have plows with nonrectangular cross sections.

In a preferred embodiment of the invention, the jamb liner is an extrusion wherein the channel portion is integral with the body portion. Consequently, the jamb liners can be relatively inexpensively manufactured.

These and other objects, advantages, and features of the invention will be more fully understood and appreciated by reference to the written specification and drawings.

BRIEF DESCRIPTION OF THE DRAWINGS

FIG. 3(*a*) is an end view of one form of the connector shown in FIG. 3;

FIG. 4(*a*) is an end view similar to FIG. 3(*a*) but showing another form of the connector shown in FIG. 3;

DETAILED DESCRIPTION OF THE PREFERRED EMBODIMENT

Figure 1:
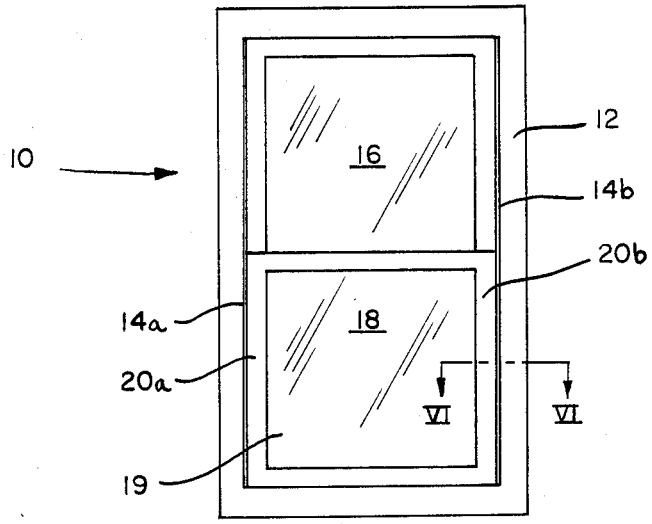
FIG. 1 is an elevational view of a cottage-style window incorporating the jamb liner of the present invention.

A window incorporating the jamb liner of the present invention is illustrated in FIG. 1 and generally designated 10. The window comprises jamb 12, a pair of jamb liners 14*a* and 14*b* which when installed are fixedly secured within the jamb, at opposite sides thereof, and upper and lower sash 16 and 18, mounted for sliding vertical movement within and between jamb liners 14. Each of the window sash 16 and 18 comprises a pair of opposite stiles 20*a* and 20*b* each of which defines a plow 22 (see also FIGS. 2 and 6) which includes generally parallel side walls and a semicircular or similarly curved inner end wall 24.

Each jamb liner 14*a*, 14*b* (FIGS. 2, 6 and 7) comprises an extrusion 26 which in use is secured flush to the wood (or other) jamb 28 of the window casing (between which an optional foam insulating pad may be secured, as by adhesive, if desired). Extrusion 26 includes body or base 30 extending the full height of jamb 12 and a pair of channels 32*a* and 32*b* which extend outwardly from the base 30 into plows 22 of upper and lower sash 16 and 18, respectively. Each of channels 32 comprises a pair of spaced sidewalls 34*a* and 34*b* which terminate in curved projecting portions 36*a* and 36*b*, respectively, which are closely proximate and generally conform to the shape of the curved inner end wall 24 of the sash plow 22. A pair of abutment walls 38*a* and 38*b* extend inwardly toward one another from sidewalls 36*a* and 36*b*, respectively,to provide a surface against which friction shoe 50 (FIGS. 2 and 6) bears while riding within channel 32.

Shoe 50 is frictionally but slidably retained between base 30 and abutment walls 38 to support sash 18 on a connector, or foot, 52 (FIGS. 2, 3 and 4) extending between the shoe and the sash stile. Indirect support of abutment walls 38 by curved sidewall portions 36 against plow 22 may in some cases help insure that the abutment walls do not flex excessively under the pressure of shoe 50, since such flexure is not tolerable if superior operation is to be provided; however, it is more preferable that the structure (abutment walls, etc.) of the jamb liner channels be self-supporting, so as not to impose loading forces between the curved walls of the plow and the complementary curved sidewall projections 36*a* and 36*b*.

Consequently, it will be seen that the present invention enables for the first time the use of the friction shoe concept in sash defining nonrectangular plows, and thus provides a new form of double-hung window with new operating characteristics, in particular providing a "non take-out" double hung or cottage-style window with a friction shoe positioner.

Upper and lower sash 16 and 18 are generally similar to one another; consequently, only sash 18 will be described in detail, upper sash 16 typically being the logical counterpart thereof. Sash 18 (FIGS. 1, 2 and 6) includes glass 19 supported between a pair of stiles 20*a* and 20*b*, each of which defines a plow 22 opening toward jamb liner 14 and receiving one of the projecting channels 32. Each plow 22 includes a pair of spaced, parallel, linear sidewalls 48*a* and 48*b* interconnected by a concave, semicircular inner end wall 24. Most commonly, stile 20 is fabricated of wood and plow 22 is approximately five-eighths inch deep at the innermost portion of curved end wall 24. The sash preferably include weather seals (not shown) and a dust pad (not shown) which may be in accordance with measures generally known in the art.

Figure 6:
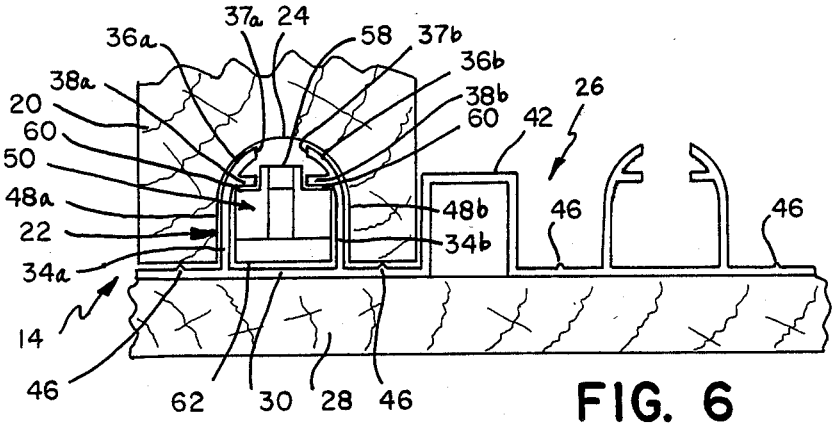
FIG. 6 is a sectional view of the jamb liner and window sash taken along plane VI—VI in FIG. 1.

Turning more specifically to other details of the jamb liner 14 as shown in FIG. 6, a foam or like insulation pad (not specifically shown), although not an essential element, may be included for the additional benefits it affords. If so used, it preferably runs the full height of and is secured to body 32 by use of a suitable adhesive, and thus provides a weather seal and jamb cushion between extrusion 26 and jamb 12. Extrusion 26 (FIGS. 2, 6 and 7) is preferably fabricated as an extrusion of polyvinyl chloride or other suitable polymeric material, with channels 32 being integral with body 30. Body 30 includes U-shaped spacer 42 in its central portion which acts as a spacer and a weather seal between sash 16 and 18, both of which abut the spacer.

Figure 7:
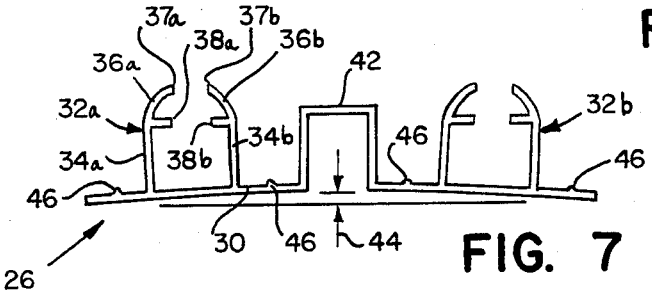
FIG. 7 is a sectional view of the jamb liner extrusion.

As illustrated in FIG. 7, the body 30 is preferably pre-stressed (bowed), with approximately a five-degree camber, as indicated by arrows 44. This tends to improve and enhance the shape (i.e., squareness) of the channels after the jamb liner body is installed and secured flush against the jamb with which it is to be used; additionally, this approach (pre-stressing) may be utilized to insure or to augment good frictional contact between the friction shoe 50 and the abutment walls 38. That is, the abutment walls 38 may be formed initially with a slight acute angle toward the adjacent sidewall (e.g., 34*a* or 34*b*), thereby requiring at least a minute degree of flexure of the sidewalls by the friction shoe as the latter is moved along the channel (i.e., sufficient flexure to remove the predisposed acute angle and position the abutment walls approximately perpendicular to the sidewalls).

Channels 32*a* and 32*b* are generally identical to one another; consequently, only channel 32*a* will be described in detail. Each channel 32 is defined primarily by a pair of spaced sidewalls 34*a* and 34*b*, which extend generally perpendicularly from body 30 and terminate in arcuate or curvilinear projecting end portions 36*a* and 36*b*, respectively, including terminal edges 37*a* and 37*b*, respectively. In the assembled window (FIG. 6), arcuate portions 36 lie closely proximate, and generally conform, to the curved inner end wall 24 of the plow 22 in stile 20. Abutment walls 38*a* and 38*b* are each located mediate terminal edge 37 and body 30 and extend inwardly toward one another from, and generally orthogonal to, sidewalls 34*a* and 34*b*, respectively, to define a friction surface for the shoe component 50.

Both the spaced end portions 36*a* and 36*b* and the spaced abutment walls 38*a* and 38*b* define an opening of approximately the same width to allow the foot, or connector, 52, to communicate with and connect to the shoe component 50 which is disposed within channel 32*a*. All along the height of jamb liner 14, including the position at which friction shoe assembly 40 is located, the curved end portions 36*a* and 36*b* of the channel preferably exert little or no pressure on the walls defining the plow 22 in stile 20. In the vicinity of shoe assembly 40, the pressure of shoe component 50 against abutment walls 38 may tend to force terminal portions 36 outward and into light engagement with stile 20 to support the abutment walls, but this is not essential and in fact is not preferred. A plurality of spacing ridges 46 (FIGS. 6 and 7) preferably run the full length of extrusion 26 and serve to space the outside edges of both stiles 20*a* and 20*b* for both sash 16 and 18 outwardly slightly from the generally flat main portion of body 30, to reduce friction between the sash and jamb liner 14 during sash movement.

Friction shoe assembly 40 (FIG. 2) basically comprises a friction shoe component 50 and a sash-to-shoe connector 52. Friction shoe 50 is generally of the type disclosed in FIG. 9 of U.S. Pat. No. 3,466,806, entitled BALANCE STRUCTURE FOR WINDOWS AND THE LIKE, issued Sept. 16, 1969, to Teggelaar et al. and assigned to the assignor herein. Briefly summarizing, shoe 50 (FIG. 5) comprises body 54 (preferably of polymeric material) and a leaf spring 56 (e.g., of sheet metal) supported therein. Body 54 includes spring hook 58 and front and rear walls 60 and 62 depending downwardly therefrom. Face rib 63 extends from face 60, and threaded aperture 76 extends through the upper end of both the face rib and front wall 60 to receive an adjusting screw 74. A connector-receiving lower portion 64 interconnects walls 60 and 62 at their lower ends and defines an aperture 66 for receiving the connector 52, and a vertical groove 67 (FIG. 2) may be included (as discussed below) in the face (i.e., front) of lower portion 64, extending diametrically through aperture 66 in rib 63. A rib 68 extends toward front wall 60 from rear wall 62, over which leaf spring 56 is flexed into a bow shape spring 56 being supported at its opposite ends in upper and lower pockets 70 and 72. The bias of spring 56 may be varied by rotating an adjusting screw 74 within its aperture 76, which screw bears on the upper end of spring 56. Spring 56, through rib 68, urges rear wall 62 away from front wall 60.

Figure 3:
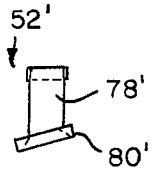
FIG. 3 is a side elevational view of a second form of the sash-to-friction shoe connector.
Figure 3:
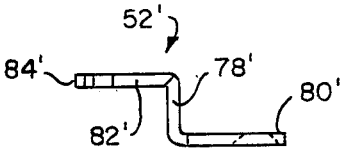
Figure 4:
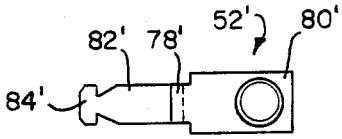
FIG. 4 is a top plan view of the sash-to-friction shoe connector of FIG. 3.
Figure 4:
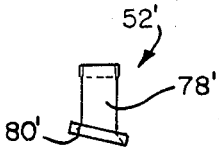
Figures 2, 5:
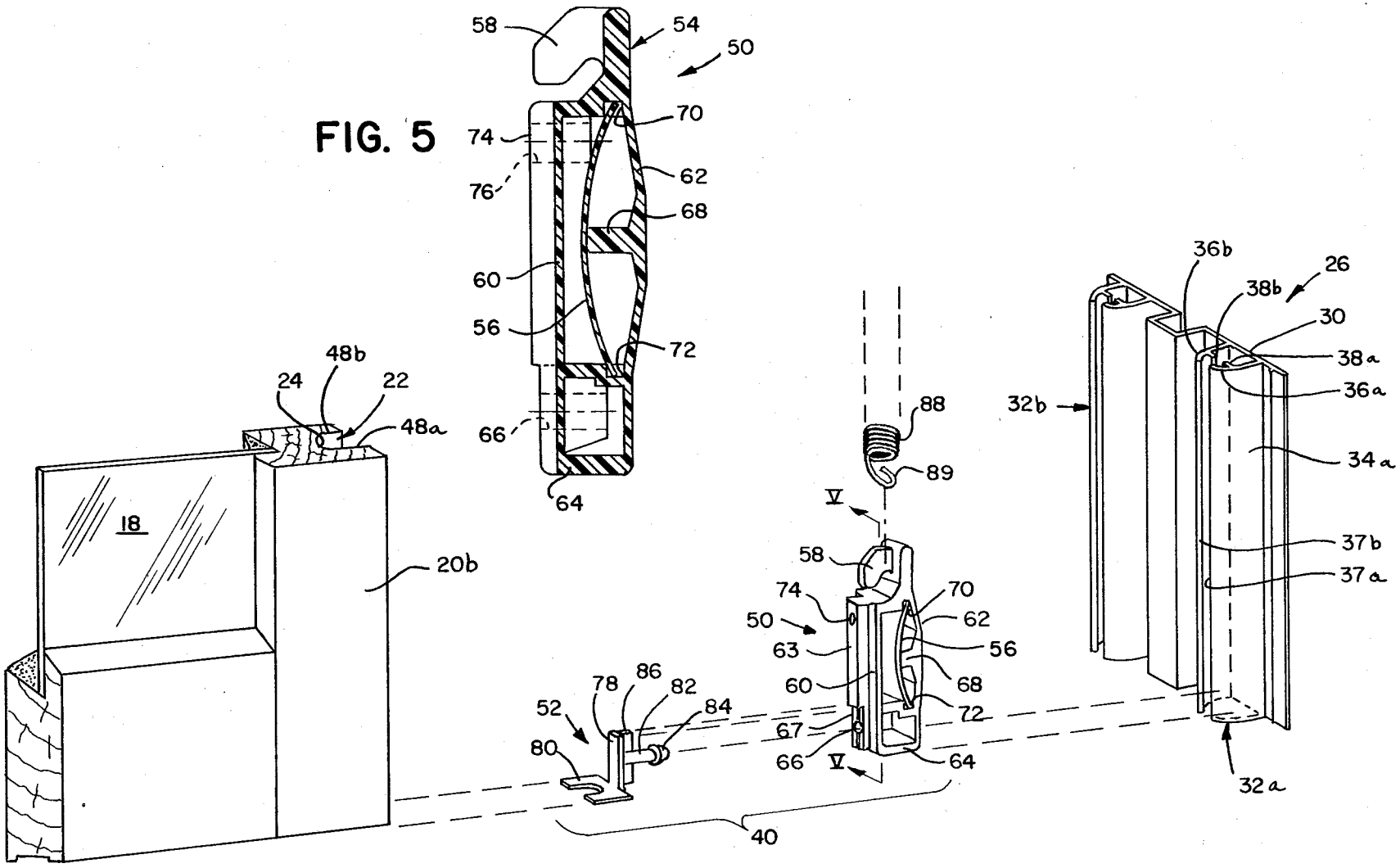
FIG. 2 is a fragmentary, perspective, exploded view of the sash, friction shoe, and jamb liner extrusion.
FIG. 5 is a sectional view of the friction shoe taken along plane V—V in FIG. 2.

The friction shoe connector 52/52′ is depicted by way of two embodiments, shown in FIGS. 2, 3 and 4. These two embodiments are in general very similar from an overall structural standpoint, the principal difference being that embodiment 52 in FIG. 2 is preferably a polymeric part which lends itself to manufacture by injection molding techniques, while embodiment 52′ of FIGS. 3 and 4 is preferably a metal part which is readily manufacturable by stamping operations. In either case, the overall structure includes a main body 78 (or 78′), a foot 80 (or 80′) extending from main body 78 or 78′, and an arm 82 (or 82′) extending from the body opposite and slightly above the foot. Arm 82/82′ includes a barb 84/84′ or other such interference-lock projection which locks behind front face 60 of the friction shoe component to secure shaft 82/82′ within aperture 66. Both arm 82/82′ and foot 80 are generally parallel to one another and perpendicular to body 78/78′, and the foot 80/80′ fits beneath the adjacent stile (20*a* or 20*b*) so as to support the sash from each opposite side at that position.

In the case of the molded part 52, a vertical longitudinal ridge 86 is preferably included which extends from body 78 in a common direction with arm 82 and interfits within the aforementioned groove 67 of the friction shoe component 50 to maintain the connector and friction shoe in fixed mutual alignment. This particular measure although not deemed strictly necessary or essential, is nonetheless desirable and a counterpart structure is present in the stamped sheet-metal version of the foot or connector 52′ shown in FIGS. 3 and 4; that is, a similar result may be obtained with different structure on the connector 52′ by making the friction shoe aperture 66 in the form of a slot rather than a circle, the slot being sized to closely accommodate the flat arm or projection 82′ of connector 52′.

With respect to further details of the connectors 52 or 52′; it should be noted that (as illustrated in FIGS. 3(*a*) and 4(*a*) with respect to connector 52′) the foot portions 80′ (or 80) are preferably disposed in angular relation with respect to the plane of arm or projection 82′ in certain instances, e.g., for sash intended to be used as lower units in a double-hung window. The reason for this is that the sills at the bottom of such windows are similarly angled outwardly and downwardly (for rainfall run-off) and the bottoms of the sash themselves are also angled accordingly; thus, the shape and orientation of the foot portions should complement and generally conform to existing sash and sills (regardless of whether connector 52 or connector 52′ is used). In the upper sash of such double-hung windows, the sash bottom is horizontal rather than angled; consequently, no angling of the foot portions is necessary for connectors used on such upper sash.

As for the aforementioned barb or interlock 84 or 84′ of connectors 52 and 52′, it will be noted (FIG. 2) that the barb 84 of connector 52 comprises an enlargement on the end of arm 82, the width of the arm 82 being slightly smaller than that of friction foot aperture 66 so as to be readily received therein while the width of enlarged barb 84 is slightly larger than that of aperture 66, to lock behind the latter. To facilitate entry of the barb 84 within and passage through aperture 66, the barb may be slotted so as to become resiliently and flexibly compressible. Similar proportioning is also preferred for the connector 52′, i.e., the width of barb 84′ is preferably slightly greater than that of the arm projection 82′, while the width of the complementary receiving slot in friction shoe 50 (not specifically illustrated), is then approximately the same as that of arm portion 82′, the barb 84′ thus seating behind the slot to interlock the connector with the friction shoe. In this relationship, where the connector 52′ is of sheet metal and the friction shoe 50 is a polymer (i.e., "plastic"), the polymer is likely to be elastically deformable to the extent necessary to allow penetration of the enlarged barb, without slotting or flexing of the latter.

Spring 88 (FIG. 2) is preferably a flocked coil spring, which provides upwardly-directed support to friction shoe assembly 40 when the latter is disposed within jamb liner channel 32*a*, 32*b*, thus helping to support the sash. As is also generally well known, spring 88 is secured to spring hook 58 of shoe 50 by a lower loop 89 of the spring, which fits under hook 58, and the spring is secured to an upper end (not visible) of jamb liner 14, by an upper loop of the spring (not visible) hooked upon or otherwise secured to body 30.

Assembly and Operation

Jamb liner 14, friction shoe assembly 40, and spring 88 are typically sold, and used, as a single commercial unit. During manufacture, one friction shoe component 50 is inserted into each of the channels 32, and an appropriate length spring 88 is secured between the friction shoe component hook 58 and the upper edge of jamb liner body 30. Foot or connector 52/52′ is snap-fitted into shoe component 50 and extends outwardly from channel 32 to support one side of a sash 16 or 18. Screw 74 in friction shoe component 50 is factory preset to provide a standard preselected frictional force for the shoe component 50 within channel 32.

Window 10 is installed by interfitting the two sash 16 and 18 between the two spaced jamb liners 14. More particularly, upper sash 16 is fitted between channels 32*b* on the opposite jamb liners 14, and lower sash 18 is fitted between channels 32*a*. With the connector feet 80 in place beneath (or otherwise engaging) their respective sash and friction shoe components, the jamb liners and sash assembly are then slid as a unit between opposite jambs 12, and properly positioned there. The jamb liners are then secured within jamb 12 to opposite jambs 28 using staples, nails, screws or any other suitable fastening means. Installation of window 10 is completed by framing the window width with suitable trim pieces (not shown).

Sash 18 is supported within jamb 12 on feet 80 of friction shoe assemblies 40. Sash 18 is supported both through the tension in spring 88 and the frictional engagement of shoe 50 within channel 32. Consequently, sash 18 may be positioned at an infinite variety of locations along its vertical travel. Movement of sash 18 is facilitated by the balancing effect of spring 88, which in essence offsets gravitational forces acting on the mass of the sash, while the selected positions of the sash are stabilized and specifically maintained by friction shoe 50.

As most clearly seen in FIG. 6, rear and front walls 62 and 60 of shoe 50 exert a frictional force on body 30 and abutment walls 38, respectively. The conformance between curved channel sidewall portions 36 and the curved end wall 24 of the plow 22 insures that support is provided to abutment walls 38, although as already explained frictional contact therebetween is neither necessary nor desired. As pressure is exerted on abutment walls 38 by friction shoe 50, those portions of curved sidewall 36 closest to the friction shoe will support the abutment walls against outward flexing movement (whether by flexing into engagement with the plow 22 of stile 20 or by virtue of the internal structural strength of the various channel walls), thereby providing the resistance required for smooth, even operation and feel of sash 18 within jamb liners 14.

The foot 80, body 78 and shaft 82 of friction shoe connector 52 are disposed outwardly of channel 32 (through which the shaft 82 extends) to engage the undersurface of sash 18, to support the sash. Preferably, the foot 80 is secured to the underside of the sash, at the stile, as by a staple screw or the like. The friction resistance provided by the friction shoe can be adjusted by rotating screw 74 within its threaded aperture, thus changing the flexure of spring 56. If the friction provided by shoe 50 is to be adjusted, foot 80 is manually drawn downward, below sash 18, until the adjustment screw 74 is accessible, below the sash and between the channel sidewall portions 36. After an appropriate adjustment is made, foot 80 is gradually raised and ultimately released, whereupon the friction shoe assembly 40 is drawn upwardly by spring 88 until the foot reengages the underside of sash 18 to again support the sash.

The jamb liner of the present invention enables the friction shoe concept to be used with window sash having nonrectangular plows. Most notably, the concept enables the use of the friction balance concept in plows having a curved or other concave inner wall. The extension of the concept to such a plow shape is enabled by the present unique jamb liner which provides the required support to the shoe abutment surface.

The foregoing description is intended to be that of a preferred embodiment of the invention. Various changes and alterations may be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A slidable window assembly comprising:

a jamb;

a sash slidable within said jamb, said sash having a plow opening toward said jamb, said plow defined by a pair of sidewalls and a concavely curved inner wall extending between said plow sidewalls;

a jamb liner having a body securable to said jamb and at least one channel extending outwardly from said body and into said plow, said channel including channel wall means extending laterally from said body, at least a portion of said channel wall means lying closely proximate and generally conforming to the shape of a portion of said concave inner plow bight wall, said channel further including friction shoe abutment wall means extending angularly from said channel wall means; and a friction shoe slidably received within said channel and engaging said body and said shoe abutment means, said friction shoe including sash support means extending from said friction shoe for movably supporting said sash from said friction shoe during movement of said shoe in said channel.

2. A window assembly as defined in claim 1 wherein said channel wall means comprises a terminal edge opposite said body; and wherein said shoe abutment wall means extends from said channel wall means mediate said body and said terminal edge.

3. A window assembly as defined in claim 2 wherein said channel wall means comprises a pair of sidewalls; and wherein each of said sidewalls includes at least a portion conforming to the shape of said concave inner plow wall.

4. A window assembly as defined in claim 3 wherein said friction shoe abutment wall means comprises first and second abutment walls extending inwardly toward one another from said first and second channel sidewalls, respectively.

5. A window assembly as defined in claim 4 wherein said sash support means comprises a connector having means for interfitting interlocking attachment to said friction shoe.

6. A window assembly as defined in claim 1 wherein said shoe abutment wall means comprises first and second abutment walls extending inwardly toward one another from said channel wall means.

7. A window assembly as defined in claim 1 wherein said channel wall means comprises a pair of sidewalls; and wherein each of said sidewalls includes a portion conforming generally to the shape of at least a portion of said concave inner plow wall.

8. A window assembly as defined in claim 1 further comprising a spring suspended from said jamb liner and connected to said friction shoe.

9. A window assembly as defined in claim 1 wherein at least portions of said body are stiffly flexible and are pre-stressed concavely relative to said jamb.

10. An improved sliding window assembly including a jamb, a jamb liner secured to the jamb, a friction shoe slidably engaging portions of the jamb liner, and a sash slidable within the jamb liner and supported by the friction shoe, the sash having a plow along its side edges and opening toward said jamb liner, wherein:

said sash plow is defined by a pair of sidewalls and a curved, concave inner end wall extending between said sidewalls;

said jamb liner having a channel extending into the sash plow, said channel including a pair of sidewalls each having end portions generally conforming to a portion of said curved, concave inner plow wall, said channel portion further including means defining a shoe abutment surface supported by said channel sidewalls; and said friction shoe disposed between said channel sidewalls and bearing against said body portion and said shoe abutment surface means, whereby said sidewalls support said abutment surface means against pressure exerted thereon by the friction shoe.

11. An improved window assembly as defined in claim 10 wherein said channel sidewalls each include a terminal edge at the extremity of said curved end portions; and wherein said shoe abutment surface means comprise wall portions extending generally orthogonally from said one channel sidewall at a point spaced from said terminal edge.

12. An improved window assembly as defined in claim 11 wherein said jamb liner includes a generally planar body portion securable to the jamb, and said channel sidewalls are supported upon said body portion; and wherein said body portion is pre-stressed by being shaped concavely relative the jamb.

13. A jamb liner and friction balance assembly for a window assembly of the type including a jamb and a sash vertically slidable within the jamb, of the type in which the sash defines a plow along at least one side having a pair of mutually spaced sidewalls and a concave inner end wall interconnecting the sidewalls, said assembly comprising:

extrusion means defining a body portion securable to the jamb in substantially flush and contiguous relation, and further defining a channel portion extending away from said body portion and into the plow, said channel portion including first and second channel wall means generally conforming to at least a portion of the concave inner end wall of the plow, said channel portion further including first and second shoe wall means extending laterally from said first and second channel wall means, respectively, toward one another;

a friction shoe sash positioner slidably received within said channel portion and frictionally engaging said body portion and said shoe wall means, and means for connecting said friction shoe within said channel portion to the sash thereadjacent such that the sash is supported in place by the friction shoe; and said channel portion and plow defining an interengaged interference structure which prevents tilting and removal of the sash from the jamb liner such that substantially non-yielding attachment of the jamb liner to the jamb thereby prevents removal of the sash from the jamb liner and jamb.

14. A jamb liner and friction balance assembly as defined in claim 13 wherein said means for connecting said sash to said friction shoe comprises a sash-supportive element extending between said first and second channel wall means and into said channel to engage said friction shoe, said element further having a foot portion to engage and support said sash outside the channel.

15. A jamb liner and friction balance assembly as defined in claim 14 wherein said sash-supportive element includes means for engaging said friction shoe by an interfitting interlocking connection.

16. A jamb liner and friction balance assembly as defined in claim 13 wherein said body portion is prestressed concavely relative the jamb.

* * * * *